US008826928B2

(12) United States Patent
Zhou

(10) Patent No.: US 8,826,928 B2
(45) Date of Patent: Sep. 9, 2014

(54) FOLDABLE TENT FRAME

(75) Inventor: Nanqing Zhou, Xiamen (CN)

(73) Assignee: Q-Yield Outdoor Gear Ltd., Xiamen, Fujian (CN)

( * ) Notice: Subject to any disclaimer, the term of this patent is extended or adjusted under 35 U.S.C. 154(b) by 0 days.

(21) Appl. No.: 13/816,226

(22) PCT Filed: Jul. 8, 2011

(86) PCT No.: PCT/CN2011/076994

§ 371 (c)(1),
(2), (4) Date: Feb. 8, 2013

(87) PCT Pub. No.: WO2013/007006

PCT Pub. Date: Jan. 17, 2013

(65) Prior Publication Data

US 2014/0109946 A1 Apr. 24, 2014

(51) Int. Cl.

| | |
|---|---|
| ***E04H 15/48*** | (2006.01) |
| ***E04H 15/06*** | (2006.01) |
| ***E04H 15/46*** | (2006.01) |

(52) U.S. Cl.

CPC ..... *E04H 15/46* (2013.01); *E04H 15/48* (2013.01); *E04H 15/06* (2013.01)

USPC ..... 135/151; 135/153

(58) Field of Classification Search

USPC ..... 135/129, 139, 153, 88.16, 151, 148, 135/137, 88.07; 296/26.04, 26.05, 26.06, 296/26.07, 160, 100.17, 100.18

See application file for complete search history.

(56) References Cited

U.S. PATENT DOCUMENTS

| | | | | |
|---|---|---|---|---|
| 2,546,730 | A * | 3/1951 | Dickerson | 280/19.1 |
| 3,027,189 | A * | 3/1962 | Scott | 297/184.14 |
| 3,405,721 | A * | 10/1968 | Crosier et al. | 135/130 |
| 3,489,452 | A * | 1/1970 | Plante | 296/161 |
| 3,575,460 | A * | 4/1971 | Kennedy | 296/160 |
| 4,250,906 | A * | 2/1981 | Rivier et al. | 296/168 |
| 4,522,441 | A * | 6/1985 | Allison | 296/160 |
| 4,612,948 | A * | 9/1986 | Simpson | 135/130 |
| 4,653,800 | A * | 3/1987 | Myers | 296/160 |
| 4,748,995 | A * | 6/1988 | Viglione | 135/130 |
| 6,209,558 | B1 * | 4/2001 | Viglione | 135/132 |
| 7,090,286 | B1 * | 8/2006 | Foreth et al. | 296/173 |
| 2012/0042920 | A1 * | 2/2012 | Armstrong et al. | 135/153 |

* cited by examiner

*Primary Examiner* — Noah Chandler Hawk

(57) ABSTRACT

A foldable tent frame includes a base, a foldable tent frame rod mounted on the base, and a middle support rod for controlling the folding and unfolding of the tent frame rod; the top end of the middle support rod is pivotably connected to a fixed position on the tent frame rod, and the bottom end is slidably and pivotably connected to the base; when the middle support rod is erected via the bottom end sliding on the base, the tent frame rod is unfolded accordingly; when the middle support rod collapses via the bottom end sliding on the base, the tent frame rod is folded accordingly; the tent can be quickly folded or unfolded by controlling the sliding of the bottom end of the middle support rod on the base, and the foldable tent frame is structurally simple and easy to operate.

8 Claims, 16 Drawing Sheets

B

C

D

F

FOLDABLE TENT FRAME

BACKGROUND OF THE INVENTION

1. Field of the Invention

The present invention relates to a tent, and more particularly to a foldable tent frame.

2. Description of the Prior Art

A tent comprises a tent tarpaulin and a tent frame to support the tent tarpaulin. The tent frame is composed of a plurality of rods. For convenient storage and carrying, the rods of the tent frame are pivotally connected by a plurality of joints to fold or unfold the tent. This structure is more complicated. Besides, each joint or fixing structure must be operated one by one when unfolding or folding the tent. The operation is troublesome and consumes a lot of time. It is not convenient for use. Accordingly, the inventor of the present invention has devoted himself based on his many years of practical experiences to solve these problems.

SUMMARY OF THE INVENTION

The primary object of the present invention is to provide a foldable tent frame which has a simple configuration and can be operated conveniently.

In order to achieve the aforesaid object, the foldable tent frame of the present invention comprises a base, a foldable tent frame rod mounted on the base, and a middle support rod to control folding and unfolding of the tent frame rod. The top end of the middle support rod is pivotably connected to a fixed position on the tent frame rod. The bottom end of the middle support rod is slidably and pivotably connected to the base. When the middle support rod is erected via the bottom end sliding on the base, the tent frame rod is unfolded. When the middle support rod collapses via the bottom end sliding on the base, the tent frame rod is folded.

Preferably, the middle support rod is provided with a control mechanism used to control sliding of the bottom end of the middle support rod. The control mechanism comprises a pull rope, a rope disk used to roll up the pull rope and a drive device used to drive the rope disk and to pull or release the pull rope. The free end of the pull rope is connected to the bottom end of the middle support rod.

Preferably, the tent frame rod comprises a front rod and a rear rod. The bottom end of the front rod is pivotally connected to one side of the base. The rear rod comprises an upper rod and a lower rod which can be folded each other. The top end of the upper rod is pivotally connected to the top end of the front rod. The bottom end of the upper rod is pivotally connected to the top end of the lower rod. The bottom end of the lower rod is pivotally connected to another side the base. The top end of the middle support rod is pivotally connected to the upper rod or the lower rod the rear rod.

Preferably, the tent frame rod comprises two rod assemblies. Each rod assembly is composed of the front rod and the rear rod. A transverse linkage rod is connected between the two rod assemblies. Each rod assembly is provided with the middle support rod.

Preferably, the control mechanism comprises two pull ropes and two rope disks corresponding to the two pull ropes. The drive device comprises a rotation rod. Two ends of the rotation rod are respectively connected to the two rope disks to drive the two rope disks synchronously.

Preferably, a worm gear is fixedly connected on the rotation rod. A worm shaft is provided to mesh with the worm gear to drive the rotation rod. The worm shaft is connected with a cranking bar.

Preferably, the base comprises two slide rails therein to cooperate with the bottom ends of the two middle support rods. Each slide rail has a rope trough along its axial direction and an accommodation trough at the tail end of the rope trough to receive the corresponding rope disk. A rotation trough is provided between the two accommodation troughs of the two slide rails. The rotation rod is located in the rotation trough. The rope disk is located in the accommodation trough. The pull rope is located in the rope trough.

Preferably, transverse linkage rod comprises a straight rod connected between the two front rods and a U-shaped rod connected between the two rear rods.

Preferably, the pull rope is provided with two fixed pulleys. A clamping groove is formed between the two fixed pulleys. The pull rope is inserted through a slide groove of one fixed pulley, the clamping groove between the two fixed pulleys and a slide groove of the other fixed pulley.

Preferably, the worm shaft is provided with a motor to drive the worm shaft. The base comprises two slide rails therein to cooperate with the bottom ends of the two middle support rods. Two ends of the slide rails are provided with route limit switches to control clockwise/counterclockwise rotation of the motor.

The advantages of the present invention are as follows:

1. The top end of the middle support rod is pivotally connected to the tent frame rod, and the bottom end of the middle support rod is slidably and pivotally connected to the base. Through the bottom end of the middle support rod to slide on the base, the tent can be folded or unfolded quickly. The configuration of the tent frame is simple and the tent frame can be operated conveniently.

2. The middle support rod is provided with the control mechanism to control the sliding of the bottom end of the middle support rod. The free end of the pull rope is connected to the bottom end of the middle support rod, and the drive device drives the rope disk to pull or release the pull rope so as to fold or unfold the tent quickly. The operation is simple and the degree of automation is high.

DETAILED DESCRIPTION OF THE PREFERRED EMBODIMENTS

Figure 1:
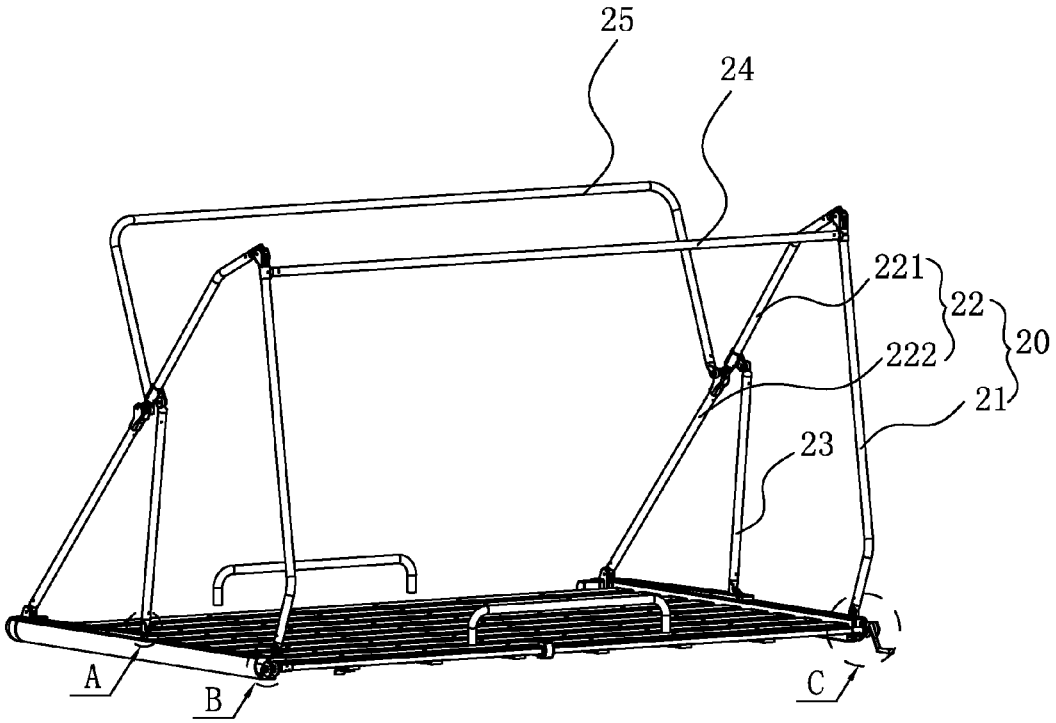
FIG. 1 is a perspective view according to a first embodiment of the present invention.
Figure 2:
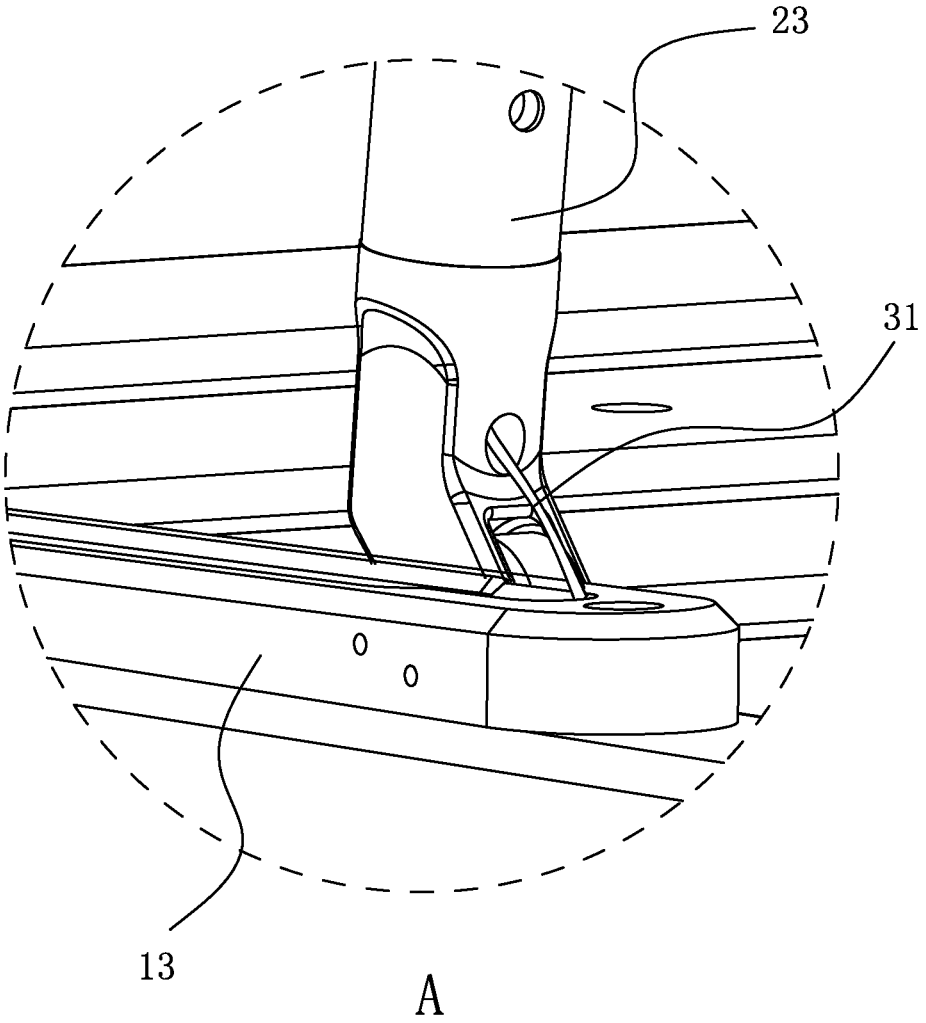
FIG. 2 is an enlarged view of circle A of FIG. 1.
Figure 3:
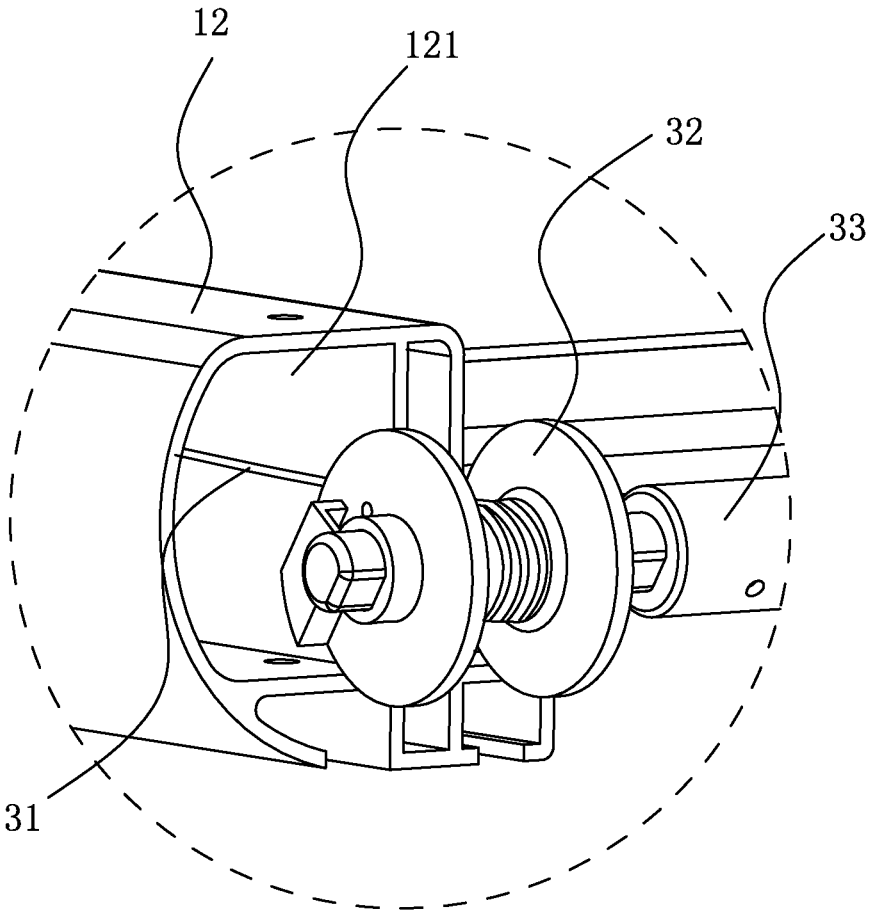
FIG. 3 is an enlarged view of circle B of FIG. 1.
Figure 4:
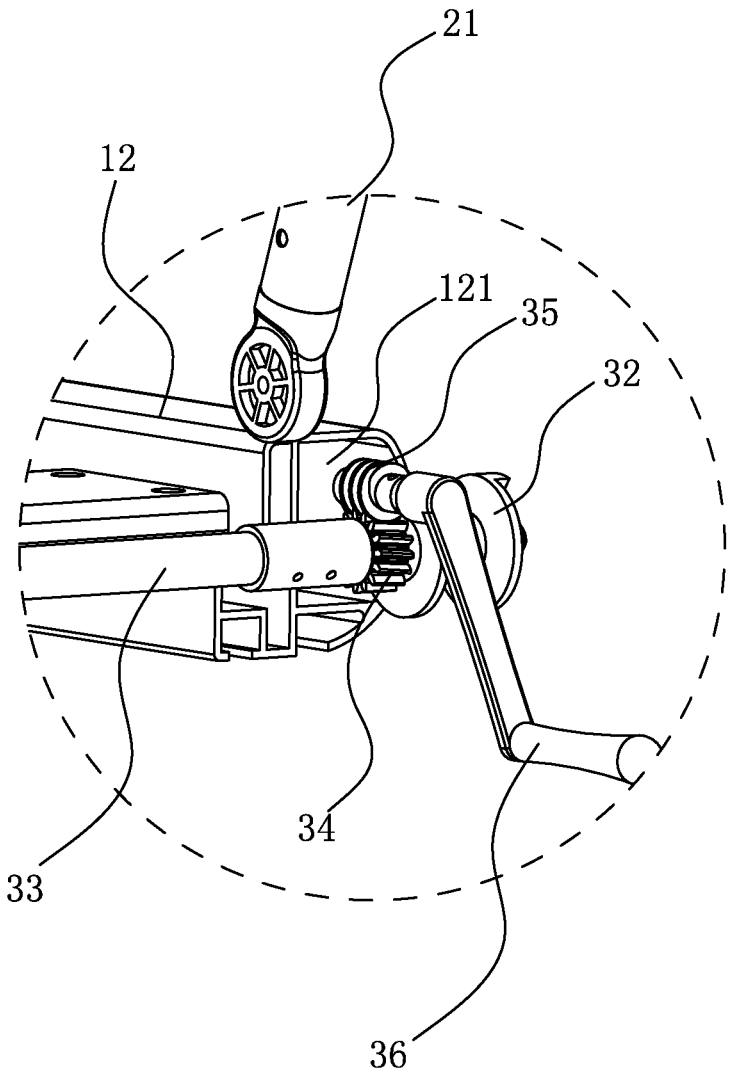
FIG. 4 is an enlarged view of circle C of FIG. 1.
Figure 5:
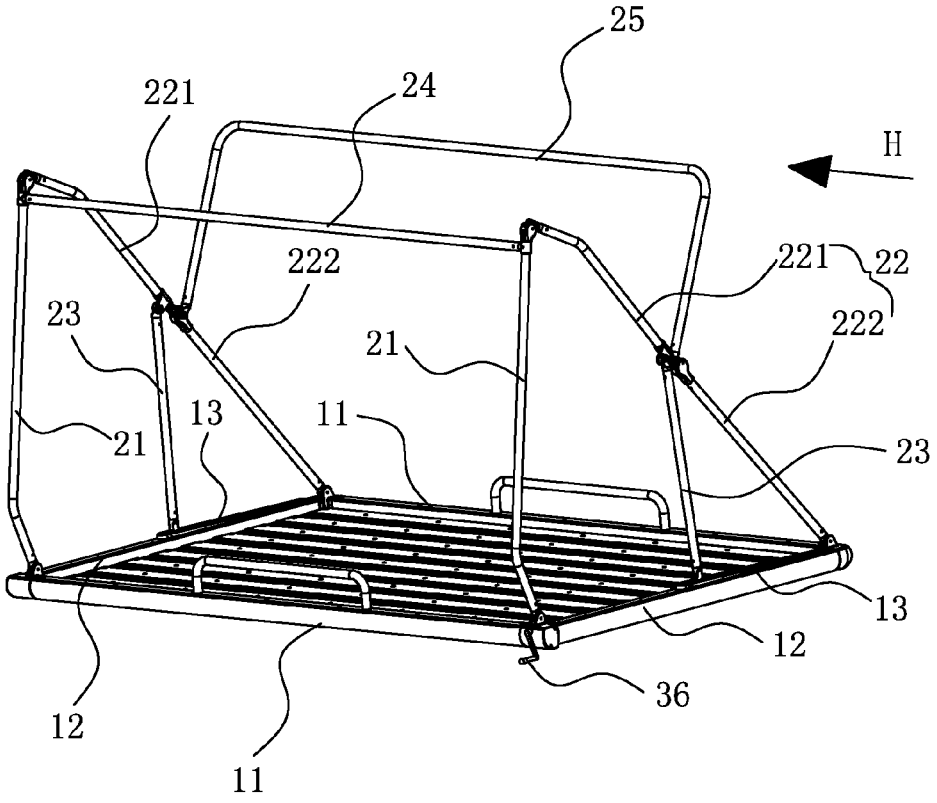
FIG. 5 is an assembled perspective view of the first embodiment of the present invention.

Embodiments of the present invention will now be described, by way of example only, with reference to the accompanying drawings.

FIG. 1 to FIG. 10 shows a first embodiment of the present invention. The foldable tent frame comprises a base 10, a foldable tent frame rod mounted on the base 10, and a middle support rod 23 for controlling the folding and unfolding of the tent frame rod. The top end of the middle support rod 23 is pivotably connected to a fixed position on the tent frame rod, and the bottom end of the middle support rod 23 is slidably and pivotably connected to the base 10. When the middle support rod 23 is erected via the bottom end sliding on the base 10, the tent frame rod is unfolded accordingly. When the middle support rod 23 collapses via the bottom end sliding on the base 10, the tent frame rod is folded accordingly.

The tent frame rod comprises two rod assemblies 20 and a transverse linkage rod connected between the two rod assemblies 20. Each rod assembly 20 comprises a front rod 21 and a rear rod 22. The two front rods 21 of the two rod assemblies 20 are parallel, and the two rear rods 22 of the two rod assemblies 20 are also parallel. A straight rod 24 is connected between the two front rods 21. A U-shaped rod 25 is pivotally connected between the two rear rods 22. In this embodiment, there are two middle support rods 23 which are pivotally connected to the rear rods 22, respectively. The rear rod 22 comprises an upper rod 221 and a lower rod 222 which can be folded each other. The top end of the upper rod 221 is pivotally connected to the top end of the front rod 21. The bottom end of the front rod 21 and the bottom end of the lower rod 222 are pivotally connected to the base 10, respectively.

Figure 7:
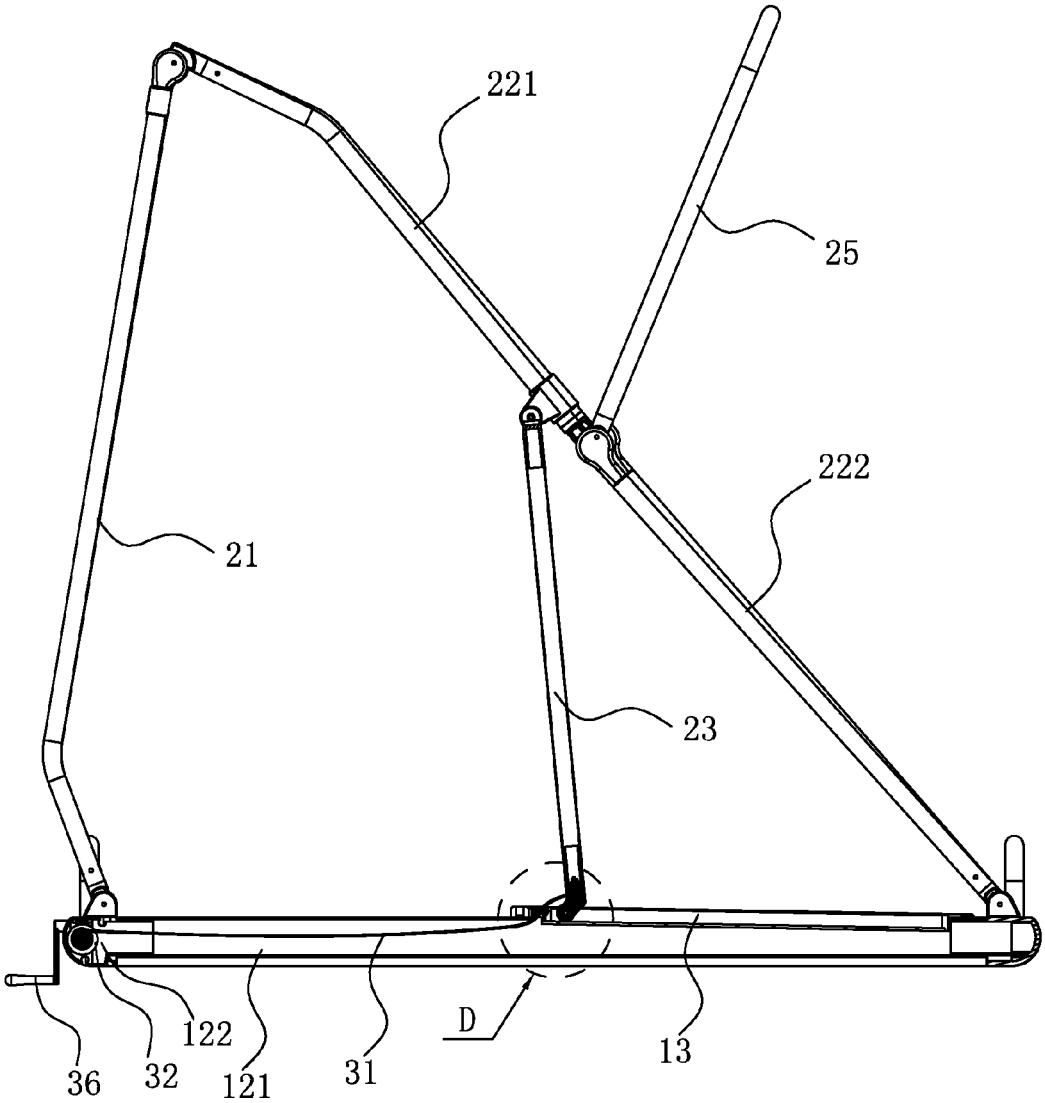
FIG. 7 is a side view of FIG. 5 in H direction to show that the tent is completely unfolded.
Figure 8:
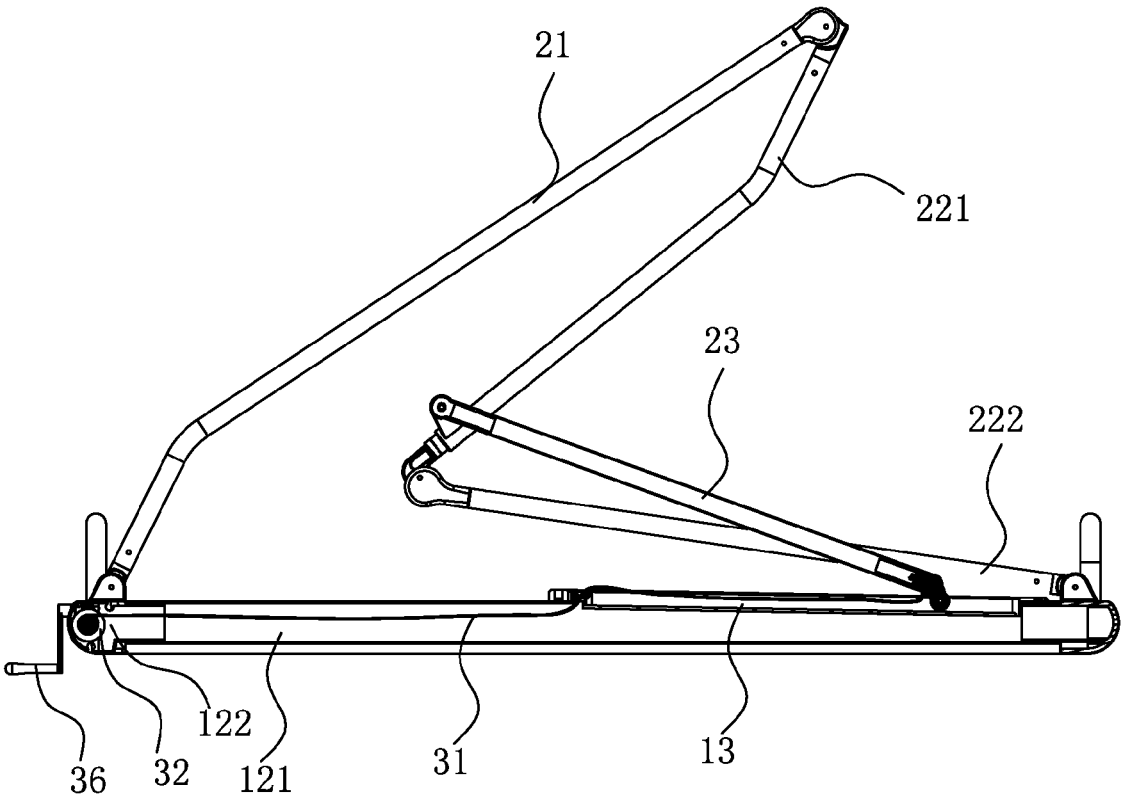
FIG. 8 is a side view of FIG. 5 in H direction to show that the tent is in a folding state.
Figure 9:
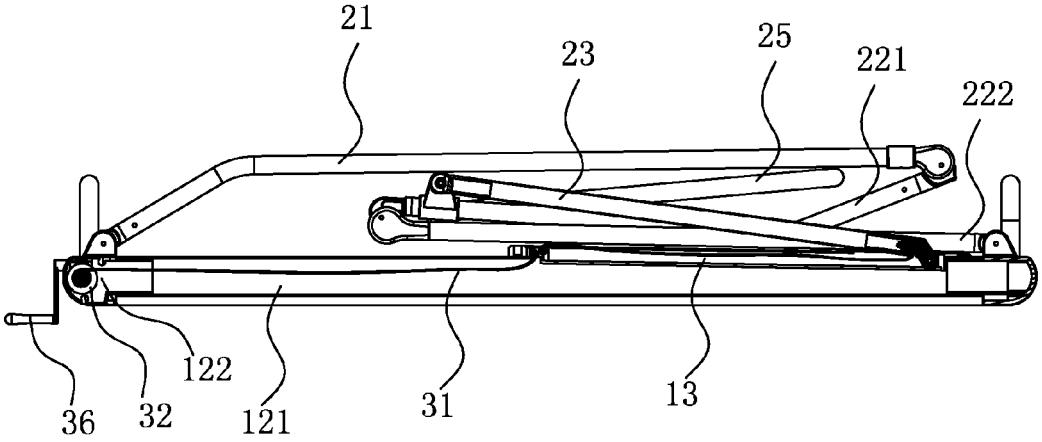
FIG. 9 is a side view of FIG. 5 in H direction to show that the tent is completely folded.

The middle support rod 23 is provided with a control mechanism used to control sliding of the bottom end of the middle support rod 23. The control mechanism comprises a pull rope 31, a rope disk 32 used to roll up the pull rope 31, and a drive device used to drive the rope disk 32 and to pull/release the pull rope 31. The free end of the pull rope 31 is connected to the bottom end of the middle support rod 23. The drive device comprises a rotation rod 33. Two ends of the rotation rod 33 are connected to the two rope disks 32 of the two middle support rods 23, respectively. The rotation rod 33 is to ensure that the two middle support rods 23 are moved synchronously so as to unfold or fold the two rod assemblies 20 synchronously. A worm gear 34 is fixedly connected on the rotation rod 33, and a worm shaft 35 is provided to mesh with the worm gear 34 so as to drive the rotation rod 33. The worm shaft 35 is connected with a cranking bar 36. Thus, the cranking bar 36 is turned manually to pull/release the pull rope 31 through the worm shaft 35 and the worm gear 34 to drive the rope disk 32 so as to control sliding of the bottom end of the middle support rod 23 to unfold or fold the tent frame. In this embodiment, the folding procedures of the tent 100 are shown in FIG. 7 to FIG. 9. The unfolding procedures are contrariwise.

Figure 6:
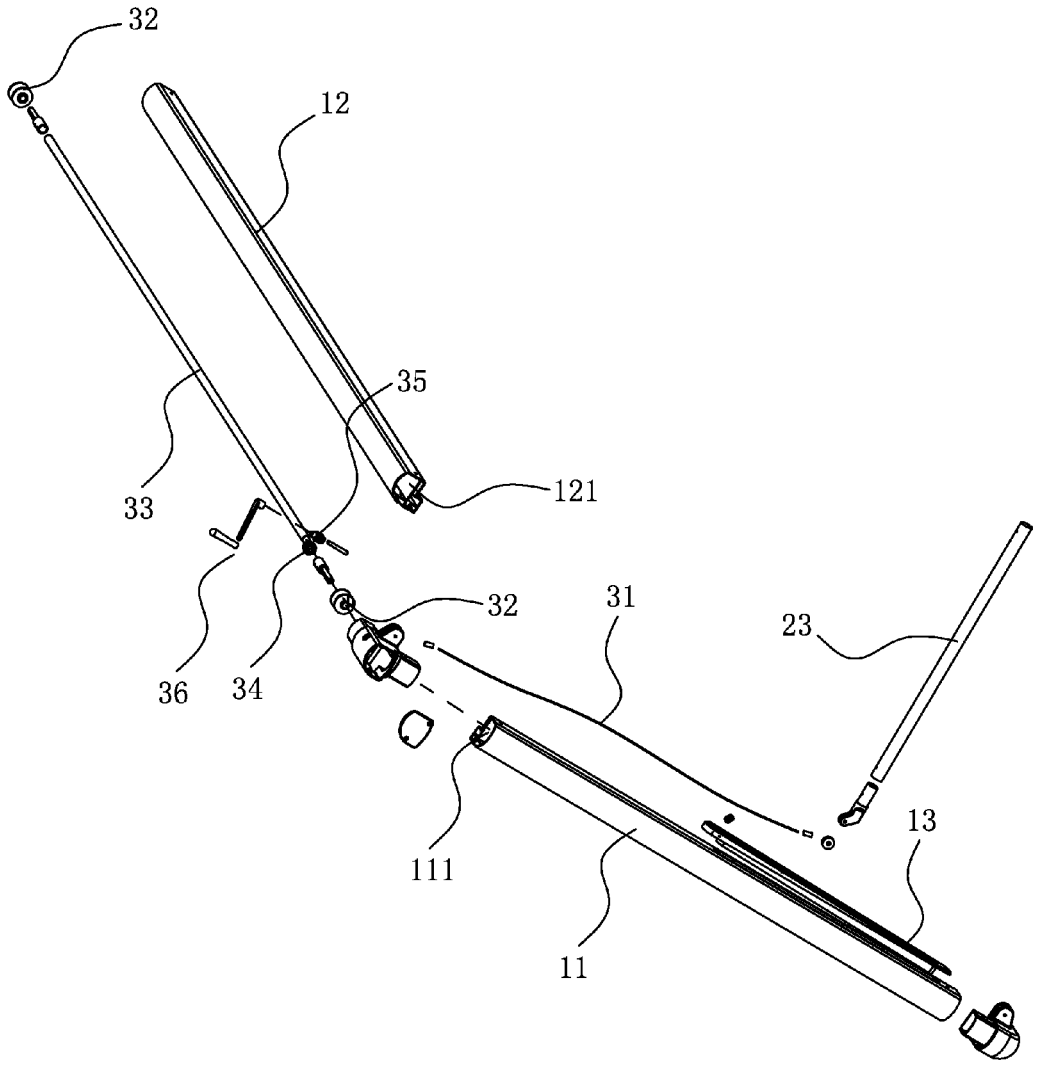
FIG. 6 is a partial exploded view of the first embodiment of the present invention.
Figure 10:
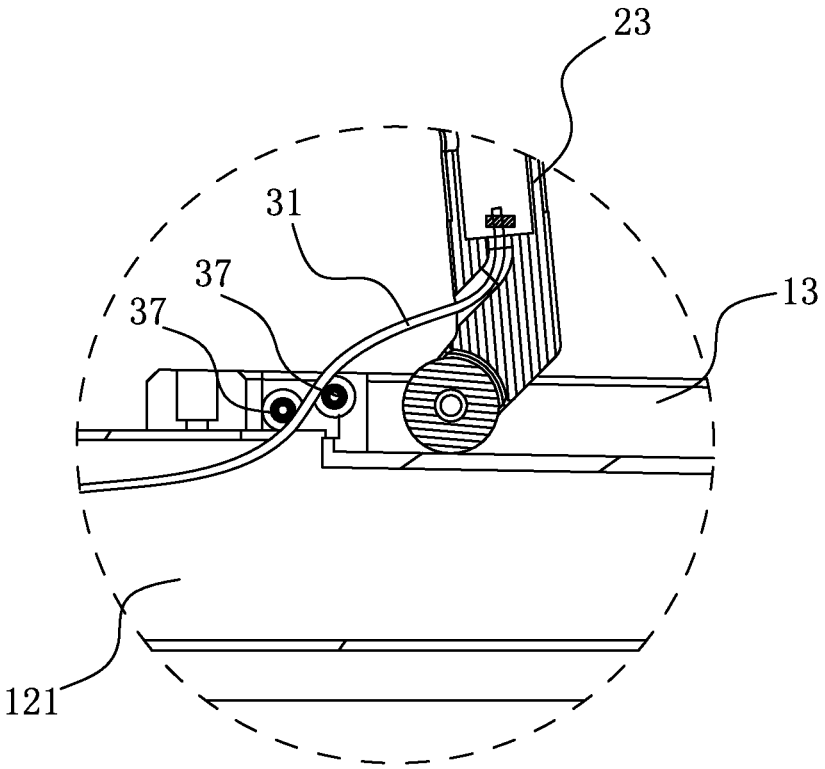
FIG. 10 is an enlarged view of circle D of FIG. 7.

The base 10 comprises two slide rails 13 therein to cooperate with the bottom ends of the two middle support rods 23. Each slide rail 13 has a rope trough 121 along its axial direction and an accommodation trough 122 at the tail end of the rope trough 121 to receive the rope disk 32. A rotation trough 111 is provided between the two accommodation troughs 122 of the two slide rails 13. The rotation rod 33 is located in the rotation trough 111. The rope disk 32 is located in the accommodation trough 122. The pull rope 31 is located in the rope trough 121. As shown in FIG. 6, in this embodiment, the four sides of the base 10 are provided with long pipes 11 and short pipes 12 to form the rotation trough 111 and the rope trough 121. As shown in FIG. 10, the pull rope 31 is provided with two fixed pulleys 37, and a clamping groove is formed between the two fixed pulleys 37. The pull rope 31 is inserted through the rope trough 121, the slide groove of one fixed pulley 37, the clamping groove between the two fixed pulleys 37 and the slide groove of the other fixed pulley 37, and then connected to the bottom end of the middle support rod 23.

Figure 11:
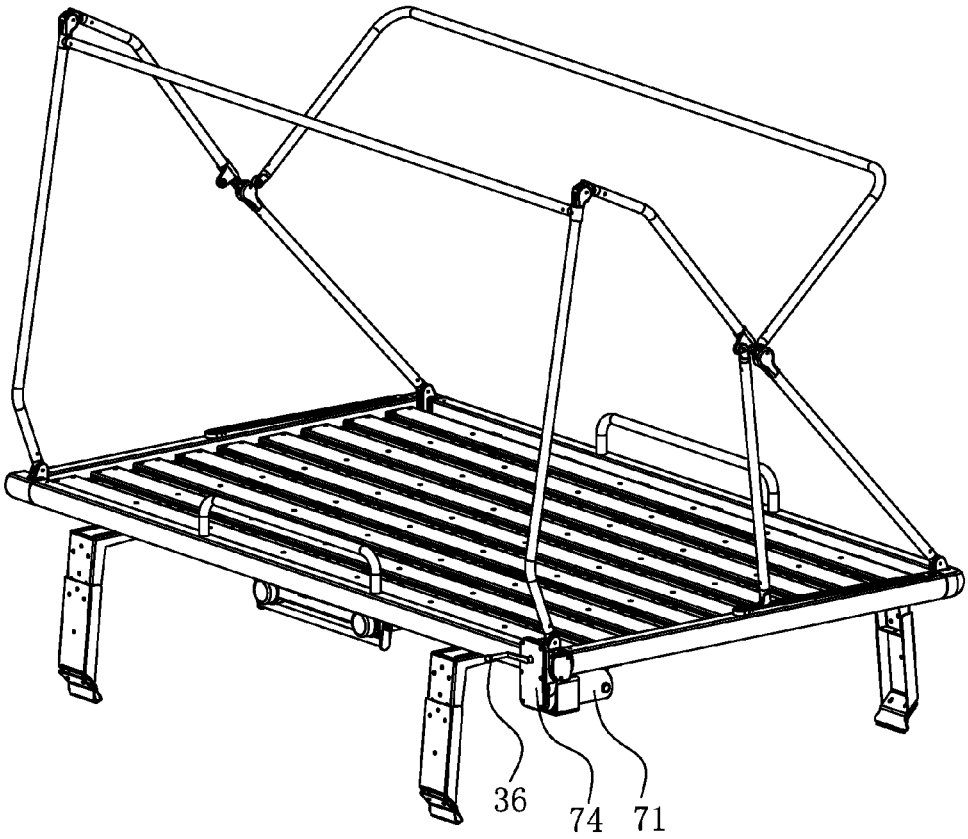
FIG. 11 is a perspective view according to a second embodiment of the present invention.
Figure 12:
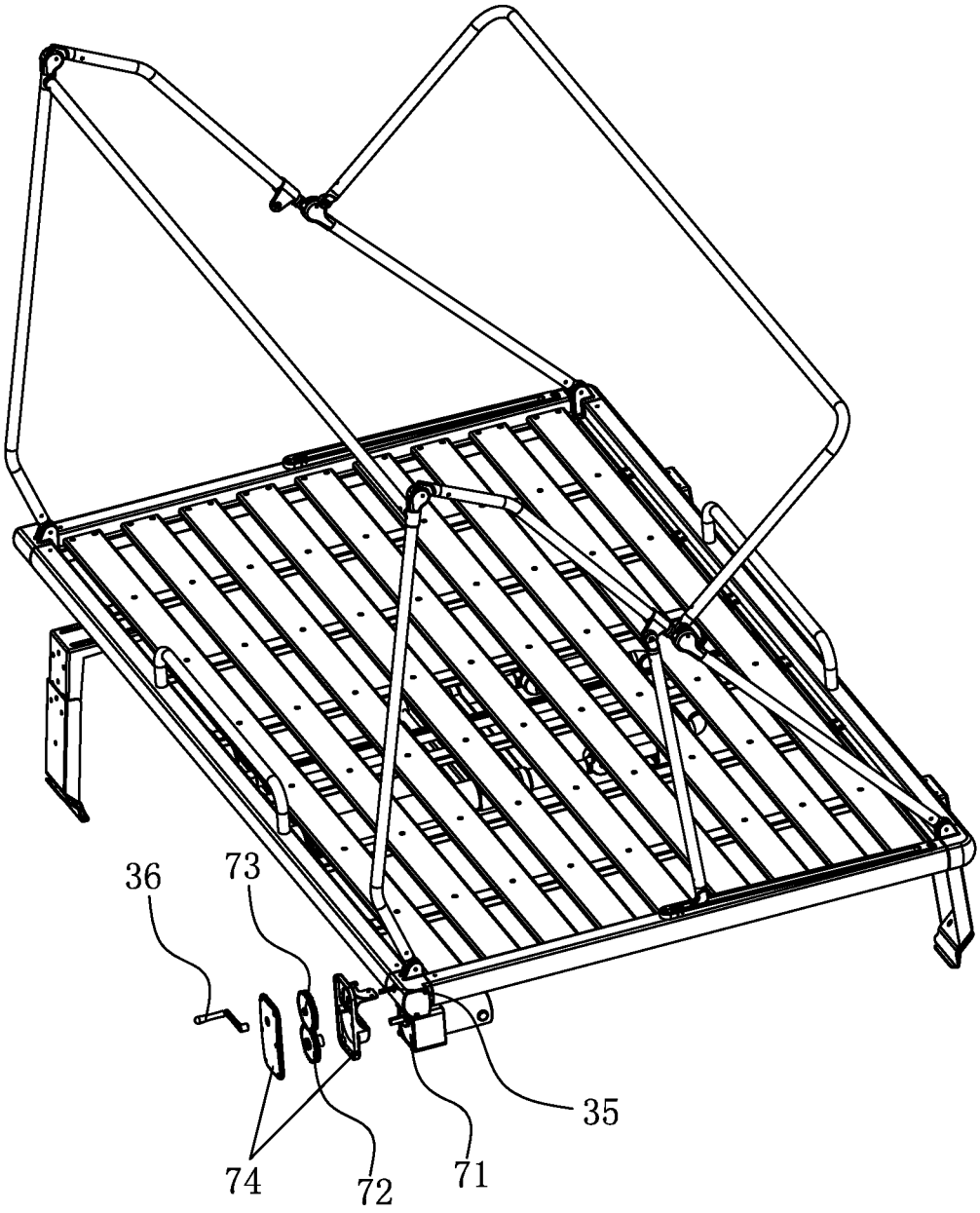
FIG. 12 is a partial exploded view of the second embodiment of the present invention.
Figure 13:
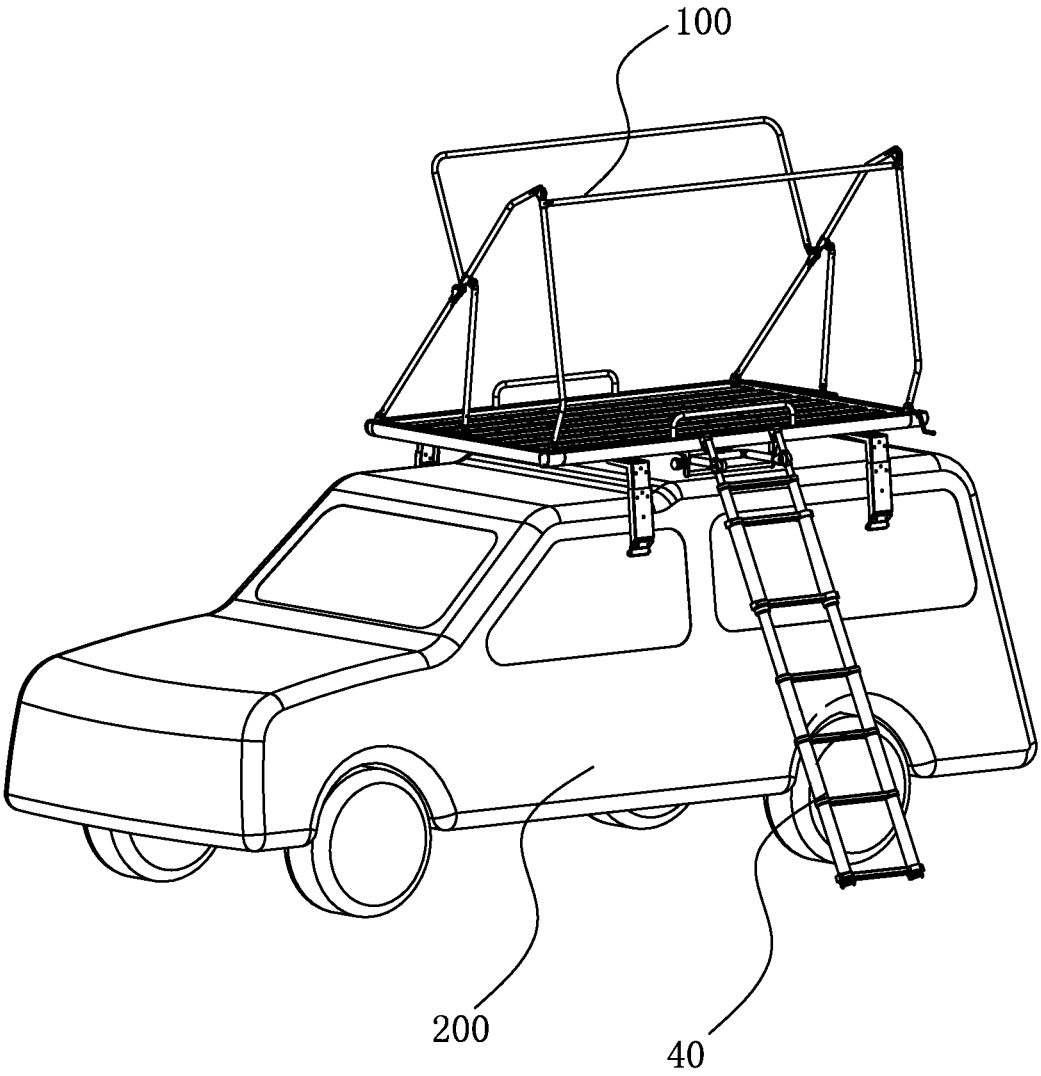
FIG. 13 is a schematic view of the first embodiment of the present invention when in use.
Figure 14:
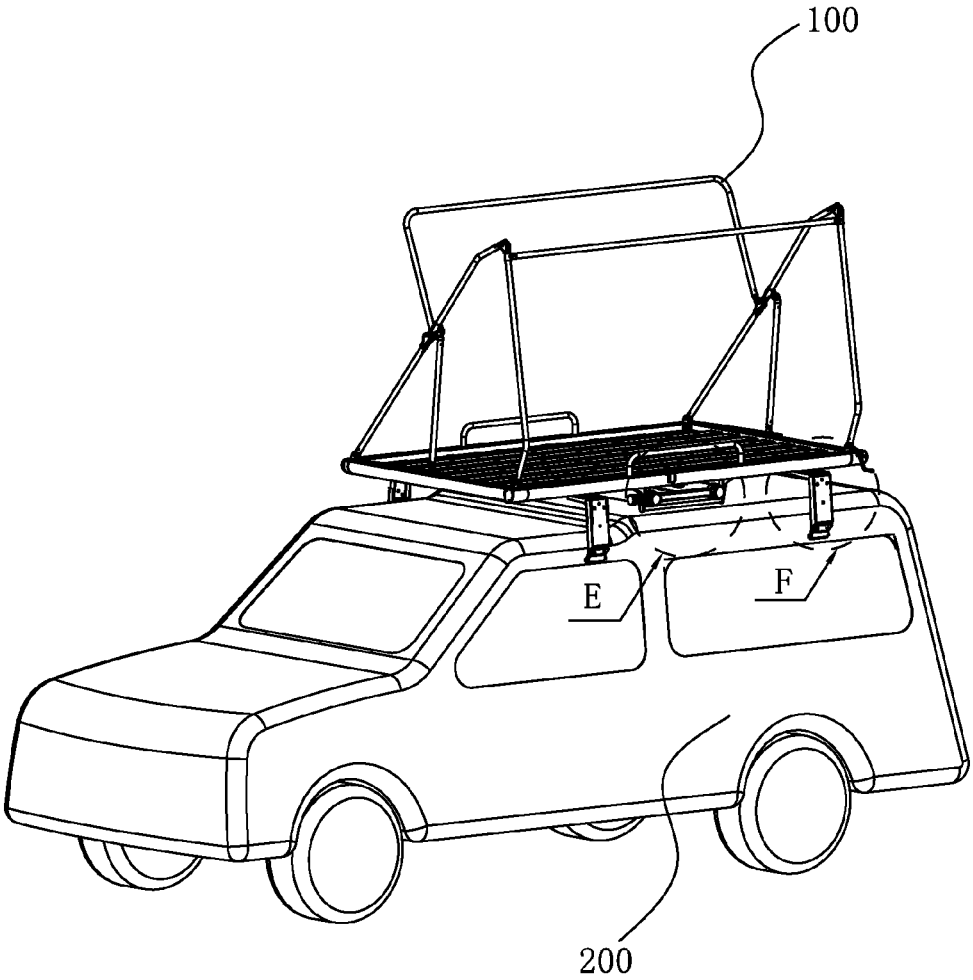
FIG. 14 is a schematic view of FIG. 10 seen from another angle.
Figure 15:
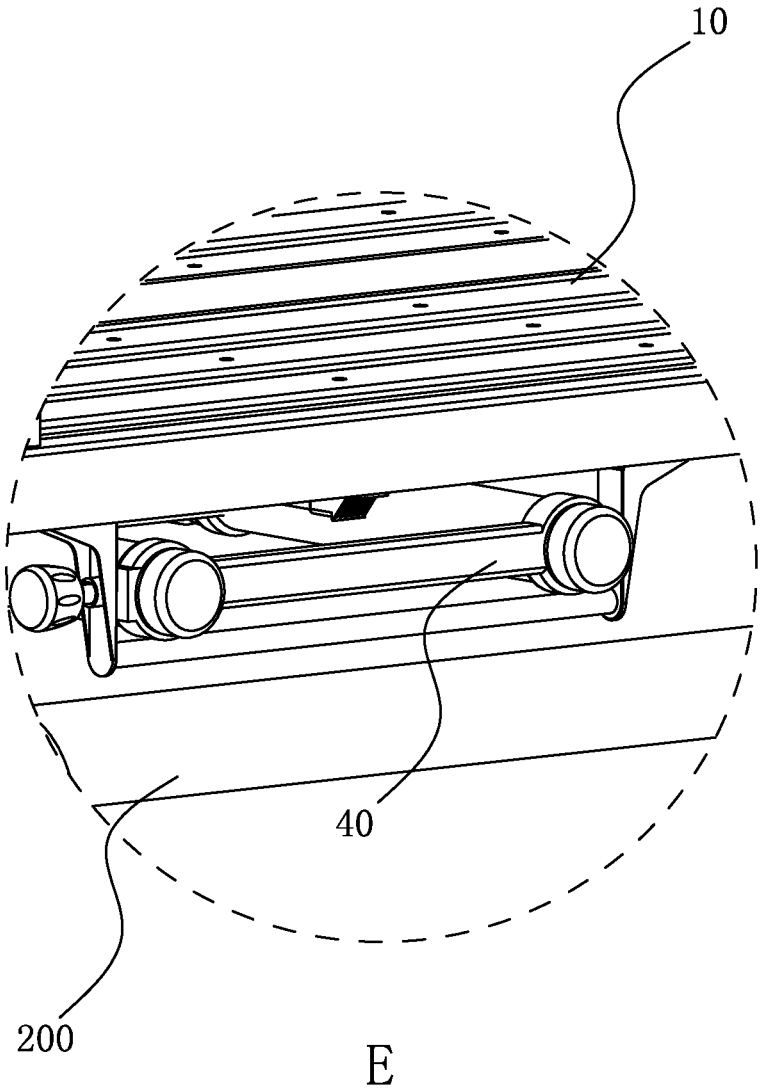
FIG. 15 is an enlarged view of circle E of FIG. 11.
Figure 16:
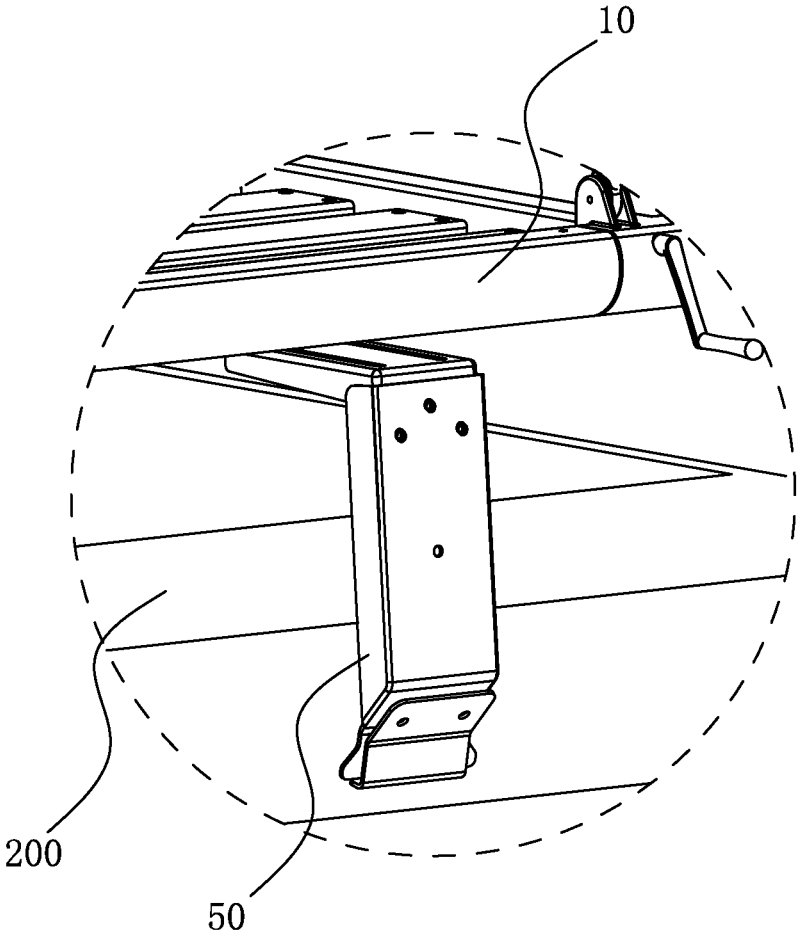
FIG. 16 is an enlarged view of circle F of FIG. 11.

FIG. 11 and FIG. 12 show a second embodiment of the present invention which is substantially similar to the first embodiment with the exceptions described hereinafter. The way to bring the worm shaft 35 is different. In this embodiment, except the cranking bar 36, the present invention further comprises a motor 71, a first transmission gear 72 and a second transmission gear 73. The first transmission gear 72 and the second transmission gear 73 mesh with each other and are mounted in a gear box 74. The motor 71 is pivotally connected with the first transmission gear 72. One end of the second transmission gear 73 is pivotally connected to the worm shaft 35, and the other end of the second transmission gear 73 is pivotally connected to the cranking bar 36. Two ends of the slide rails 13 are provided with route limit switches to control clockwise/counterclockwise rotation of the motor 71. Thus, the tent frame can be unfolded or folded by turning the cranking bar 36 manually or by the motor 71 to drive the worm shaft 35. Furthermore, the motor 71 can be provided with a controller for wireless remote control of the tent frame.

The tent 100 of the present invention can be placed on the ground or secured to the top of a car 200 when in use. For example, on an overcast and rainy day or when the location is not convenient for camping, the tent 100 cam be mounted on the top of the car 200 for use. The first embodiment is as an example. As shown in FIG. 13 to FIG. 16, the tent 100 is applied to the top of the car 200. The tent 100 is mounted on the top of the car 200 through a height adjustment frame 50 disposed under the base 10. Through the height adjustment frame 50, the tent 100 can be connected to the top of the car 200 steady and the height between the tent 100 and the top of the car 200 can be adjusted. The tent 100 can be provided with an extendable ladder 40 under the base 10. When in use, the ladder 40 is extended and placed between the ground and the top of the car 200. When not use, the ladder 40 is retracted and stored between the base 10 of the tent 100 and the top of the car 200. Thus, the user can conveniently enter the tent 100 on the top of the car 200 through the ladder 40.

The feature of the present invention is that the top end of the middle support rod is pivotally connected to the tent frame rod and the bottom end of the middle support rod is slidably and pivotally connected to the base. Through the bottom end of the middle support rod to slide on the base, the tent can be folded or unfolded quickly. The configuration of the tent frame is simple and the tent frame can be operated conveniently. Besides, the middle support rod is provided with the control mechanism to control the sliding of the bottom end of the middle support rod. The free end of the pull rope is connected to the bottom end of the middle support rod, and the drive device drives the rope disk to pull or release the pull rope so as to fold or unfold the tent quickly. The operation is simple and the degree of automation is high.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A foldable tent frame, comprising a base, a foldable tent frame rod mounted on the base, and a middle support rod to control folding and unfolding of the tent frame rod, a top end of the middle support rod being pivotably connected to a fixed position on the tent frame rod, a bottom end of the middle support rod being slidably and pivotably connected to the base, wherein, when the middle support rod is erected via the bottom end sliding on the base, the tent frame rod is unfolded, when the middle support rod collapses via the bottom end sliding on the base, the tent frame rod is folded, wherein the middle support rod is provided with a control mechanism to control sliding of the bottom end of the middle support rod, the control mechanism comprising a pull rope, a rope disk to roll up the pull rope and a drive device to drive the rope disk and to pull or release the pull rope, a free end of the pull rope being connected to the bottom end of the middle support rod; and the tent frame rod comprises a front rod and a rear rod, a bottom end of the front rod being pivotally connected to one side of the base, the rear rod comprising an upper rod and a lower rod which can be folded each other, a top end of the upper rod being pivotally connected to a top end of the front rod, a bottom end of the upper rod being pivotally connected to a top end of the lower rod, a bottom end of the lower rod being pivotally connected to another side the base, the top end of the middle support rod being pivotally connected to the upper rod or the lower rod of the rear rod.

2. The foldable tent frame as claimed in claim 1, wherein the tent frame rod comprises two rod assemblies, each rod assembly of the two rod assemblies being composed of the front rod and the rear rod, a transverse linkage rod being connected between the two rod assemblies, each rod assembly of the two rod assemblies being provided with the middle support rod.

3. The foldable tent frame as claimed in claim 2, wherein the control mechanism comprises two pull ropes and two rope disks corresponding to the two pull ropes, the drive device comprising a rotation rod, two ends of the rotation rod being respectively connected to the two rope disks to drive the two rope disks synchronously.

4. The foldable tent frame as claimed in claim 3, wherein a worm gear is fixedly connected on the rotation rod, a worm shaft being provided to mesh with the worm gear to drive the rotation rod, the worm shaft being connected with a cranking bar.

5. The foldable tent frame as claimed in claim 4, wherein the base comprises two slide rails therein to cooperate with the bottom ends of the two middle support rods, each slide rail having a rope trough along its axial direction and an accommodation trough at a tail end of the rope trough to receive the rope disk, a rotation trough being provided between the two accommodation troughs of the two slide rails, the rotation rod being located in the rotation trough, the rope disk being located in the accommodation trough, the pull rope being located in the rope trough.

6. The foldable tent frame as claimed in claim 4, wherein the worm shaft is provided with a motor to drive the worm shaft, the base comprising two slide rails therein to cooperate with the bottom ends of the two middle support rods, two ends of the slide rails being provided with route limit switches to control clockwise/counterclockwise rotation of the motor.

7. The foldable tent frame as claimed in claim 2, wherein transverse linkage rod comprises a straight rod connected between the two front rods and a U-shaped rod connected between the two rear rods.

8. The foldable tent frame as claimed in claim 1, wherein the pull rope is provided with two fixed pulleys, a clamping groove being formed between the two fixed pulleys, the pull rope being inserted through a slide groove of one fixed pulley, the clamping groove between the two fixed pulleys and a slide groove of the other fixed pulley.

* * * * *